US009920558B1

(12) United States Patent
Chou

(10) Patent No.: US 9,920,558 B1
(45) Date of Patent: Mar. 20, 2018

(54) EASILY ASSEMBLED AND DISASSEMBLED CONNECTING ASSEMBLY

(71) Applicant: Calvin Chou, Taichung (TW)

(72) Inventor: Calvin Chou, Taichung (TW)

( * ) Notice: Subject to any disclaimer, the term of this patent is extended or adjusted under 35 U.S.C. 154(b) by 0 days.

(21) Appl. No.: 15/360,006

(22) Filed: Nov. 23, 2016

(51) Int. Cl.

| | |
|---|---|
| ***E05D 7/10*** | (2006.01) |
| ***E05D 5/02*** | (2006.01) |
| ***E05D 3/06*** | (2006.01) |
| ***E05D 11/10*** | (2006.01) |
| ***E05D 11/06*** | (2006.01) |
| ***B25H 1/08*** | (2006.01) |
| ***B25H 1/06*** | (2006.01) |

(52) U.S. Cl.
CPC ..... *E05D 7/1044* (2013.01); *B25H 1/06* (2013.01); *B25H 1/08* (2013.01); *E05D 3/06* (2013.01); *E05D 5/02* (2013.01); *E05D 11/06* (2013.01); *E05D 11/1007* (2013.01); *Y10T 16/5361* (2015.01)

(58) Field of Classification Search
CPC ..... E05D 7/1044; E05D 3/06; E05D 5/02; E05D 11/06; E05D 11/1007; E05D 11/1014; E05D 5/04; E05D 11/0027; B25H 1/06; B25H 1/08; Y10T 16/5361; Y10T 16/5357; Y10T 16/5358; Y10T 16/5359; Y10T 16/5363; Y10T 16/559; Y10T 16/559963; Y10T 16/55975; Y10T 16/54; Y10T 16/54024
USPC ..... 16/265, 257–259, 270, 388, 390, 391, 16/324, 319; 182/153
See application file for complete search history.

(56) References Cited

U.S. PATENT DOCUMENTS 905,201 A * 12/1908 Magnusen ..... E05D 5/04 16/388
1,113,278 A * 10/1914 Zobel ..... E05D 5/04 16/388
1,612,656 A * 12/1926 Salin ..... E05D 3/02 16/374
1,805,401 A * 5/1931 Janney ..... E05C 19/08 16/321
2,058,341 A * 10/1936 Mink ..... E05D 5/04 16/265
2,138,847 A * 12/1938 Felix ..... B42F 13/002 114/108
2,526,209 A * 10/1950 Durup ..... E05D 11/1014 16/336
2,571,430 A * 10/1951 Durup ..... E05D 11/1014 16/335
3,970,340 A * 7/1976 Taft ..... E05D 11/0027 292/300

(Continued)

*Primary Examiner* — William L Miller
(74) *Attorney, Agent, or Firm* — Muncy, Geissler, Olds & Lowe, P.C.

(57) ABSTRACT

An easily assembled and disassembled connecting assembly includes a first connecting plate provided with a first edge and a second edge in opposite to the first edge; a second connecting plate removable and pivotally combined with the first edge for allowing the second connecting plate and the first connecting plate to open and close; and a fastening structure disposed between the first connecting plate and the second connecting plate for fastening and fixing the first connecting plate and the second connecting plate when the two connecting plates are arranged in a close status. Therefore, the two connecting plates are able to be easily assembled and disassembled.

13 Claims, 8 Drawing Sheets

(56) References Cited

U.S. PATENT DOCUMENTS 4,063,330 A * 12/1977 Triplette ..... E05D 11/1014
16/321
4,131,969 A * 1/1979 Suska ..... E05D 11/0027
16/388
4,133,114 A * 1/1979 Roach ..... E05D 11/0009
16/388

* cited by examiner

EASILY ASSEMBLED AND DISASSEMBLED CONNECTING ASSEMBLY

BACKGROUND OF THE INVENTION

1. Field of the Invention

The present invention relates to connecting assemblies, and more particularly, to an easily assembled and disassembled connecting assembly.

2. Description of the Related Art

In the manufacturing industry, such as carpenter filed, a workbench is commonly applied for positioning a to-be-processed object thereof for facilitating various processing procedures, such as sawing, drilling, or polishing.

Sometimes, the structure of a conventional workbench needs to be adjusted or varied to be applied in different processing procedures. For example, the workbench is usually added with an extension. However, during the structural adjustment or varying, a limitation upon the structure space often occurs, such that the extension is transversely exposed on the workbench, thus affecting the operational space.

Furthermore, the connecting structure between the extension and the workbench is usually complicated, such that the extension is not conveniently installed on the workbench. Even if the extension is installed on the workbench, the extension is prevented from easily uninstalled therefrom or provided with convenience of operation variation.

SUMMARY OF THE INVENTION

For improving the issues above, embodiments of the present invention disclose an easily assembled and disassembled connecting assembly, wherein two connecting plates are removably and pivotally combined to enable an extension structure to be installed on a specific position of a workbench. Also, the two connecting plates are able to be removed from each other, whereby the position of the extension structure is easily adjusted.

For achieving the aforementioned objectives, embodiments of the present invention provide an easily assembled and disassembled connecting assembly, comprising:

a first connecting plate provided with a first edge and a second edge in opposite to the first edge;

a second connecting plate removable and pivotally combined with the first edge of the first connecting plate, such that the second connecting plate and the first connecting plate pivotally move to open and close against each other; and a fastening structure disposed between the first connecting plate and the second connecting plate, the fastening structure fastening and fixing the first connecting plate and the second connecting plate when the two connecting plates are arranged in a close status.

In an embodiment of the present invention, the first connecting plate is fastened on a workbench, and the second connecting plate is fastened on an extension structure.

In an embodiment of the present invention, the first connecting plate is optionally fastened at a longitudinal position or transverse position of the workbench.

In an embodiment of the present invention, the second connecting plate is allowed to include an angle between 0 to 180 degrees with the first connecting plate, such that the first connecting plate and the second connecting plate are able to open and close against each other.

In an embodiment of the present invention, a fixing member is further included for fixing the positions of the first and second connecting plates when the first and second connecting plates are open to 180 degrees.

In an embodiment of the present invention, a positioning limiting member is further included for passing through the first and second connecting plates when first and second connecting plates are close to 0 degrees, so as to fixed the first and second connecting plates.

With such configuration, the first and second connecting plates are removably and pivotally combined with each other, thereby allowing the extension structure to be installed on or uninstalled from the workbench. Also, the extension structure is able to be move to other positions, enhancing the usage flexibility.

DETAILED DESCRIPTION OF THE INVENTION

The aforementioned and further advantages and features of the present invention will be understood by reference to the description of the preferred embodiment in conjunction with the accompanying drawings where the components are illustrated based on a proportion for explanation but not subject to the actual component proportion. Also, the description herein with references of FIG. 1 to FIG. 8 serves the purpose of illustrating embodiments of the present invention, not limiting the scope of the invention.

Figure 3:
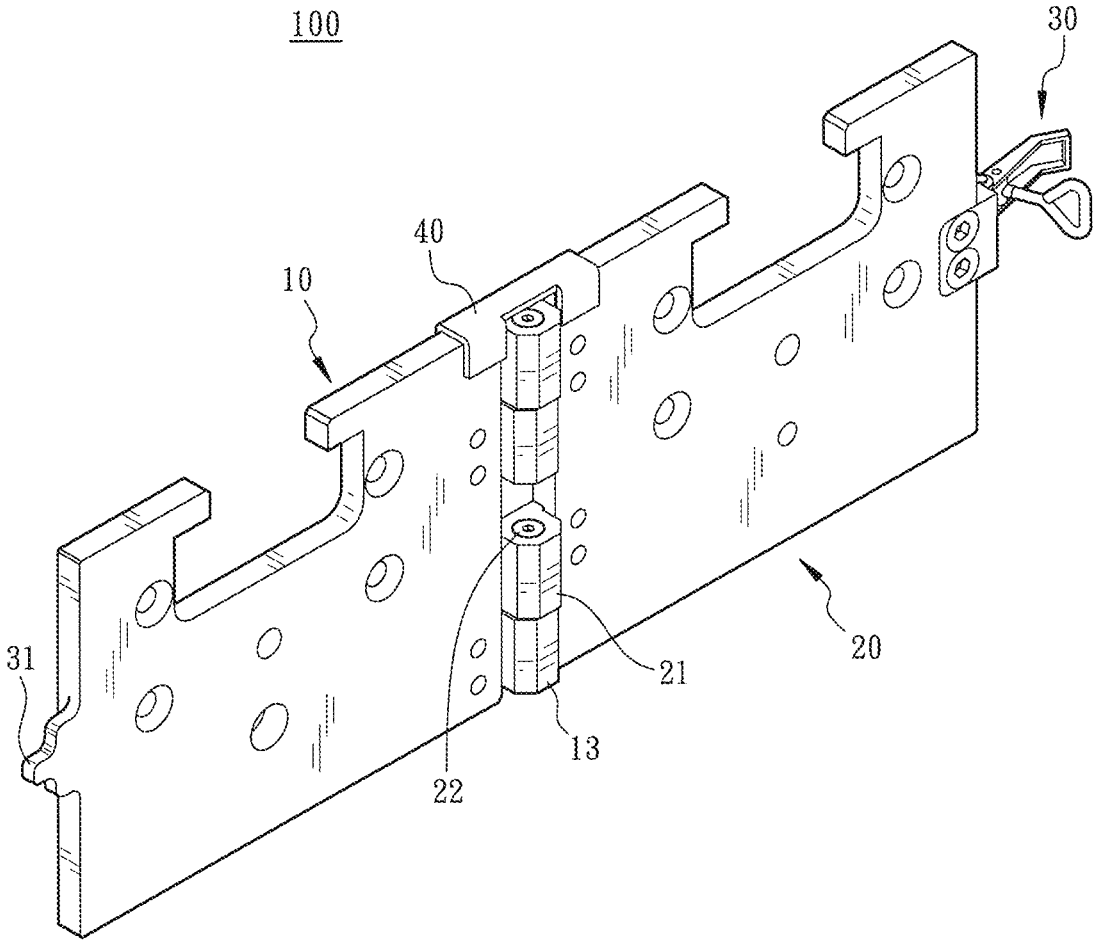
FIG. 3 is a perspective view of the connecting assembly arranged in an open status fixed by a fixing member.
Figure 4:
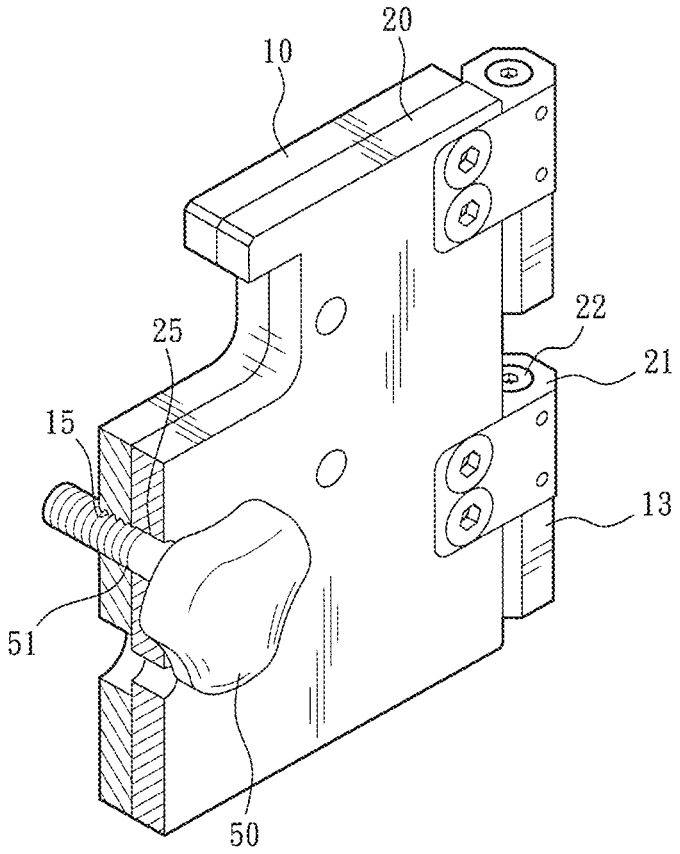
FIG. 4 is a perspective view of the connecting assembly kept in a close status by a position limiting member.
Figure 5:
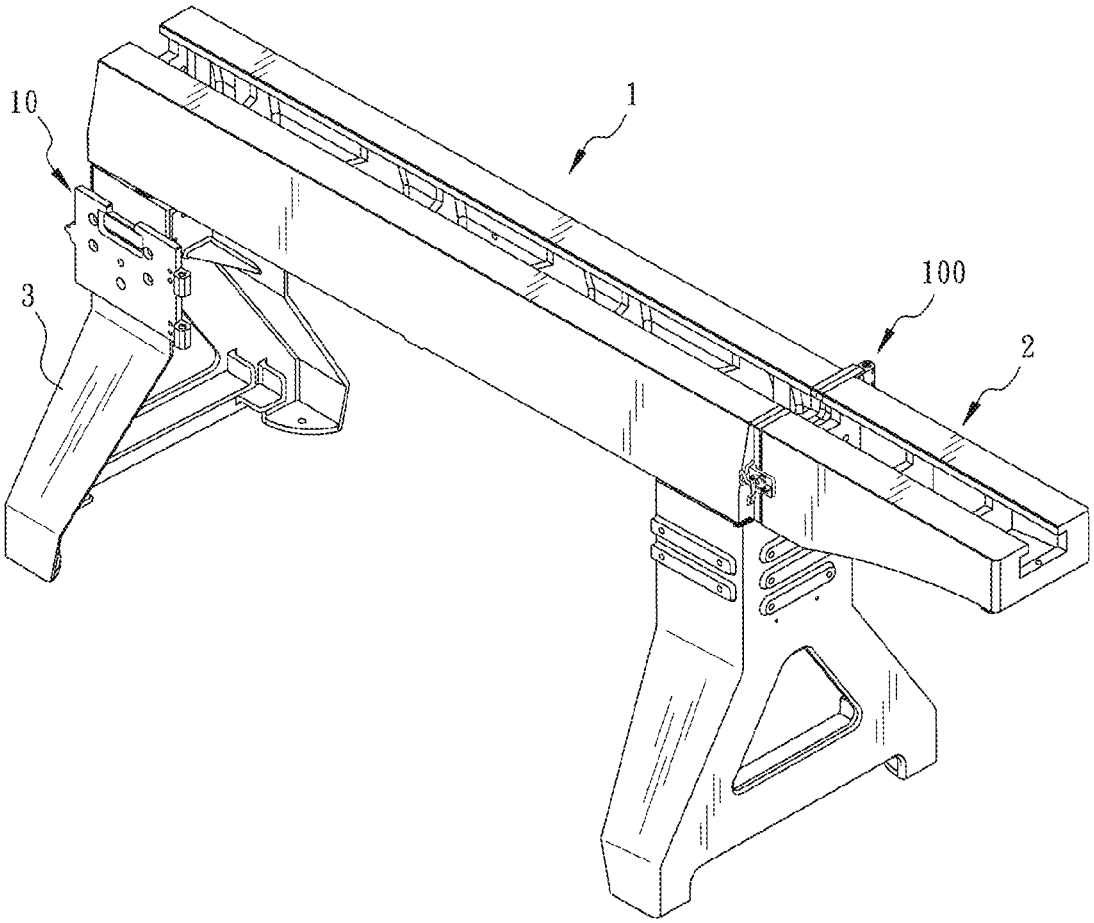
FIG. 5 is a schematic view of the connecting assembly applied on a workbench and an extension structure illustrating the extension structure being installed at a longitudinal position of the workbench.

Referring to FIG. 1 to FIG. 8, an easily assembled and disassembled connecting assembly 100 provided by an embodiment of the present invention comprises a first connecting plate 10, a second connecting plate 20, and a fastening structure 30. As shown by FIG. 5 to FIG. 8, the first connecting plate 10 is fastened on a workbench 1, such as a workbench 1 for mechanical carpenter processing. The second connecting plate 20 is fastened on an extension structure 2, and at the same time removably and pivotally combined to the first connecting plate 10, whereby the extension structure 2 is combined with the workbench 1, enhancing the convenience of carpenter processing. As shown by FIG. 5, in an embodiment of the present invention, two first connecting plates 10 are included, wherein the two first connecting plates 10 are fastened at a longitudinal position and a transverse position of the workbench 1, respectively, such that the extension structure 2 is optionally disposed on one of the positions through the second connecting plate 20.

The first connecting plate 10 is formed in a flat shape and provided with a first edge 11 and an opposite second edge 12. The first edge 11 is provided with plural first pivot portions 13. In an embodiment of the present invention, each first pivot portion 13 has a flank portion 131, so as to be fastened on a lateral side of the first edge 11 of the first connecting plate 10 through a screw member 14. Also, the first connecting plate 10 is provided with a screw hole 15.

The second connecting plate 20 is structurally similar to the first connecting plate 10. The second connecting plate 20 is provided with plural second pivot portions 21 corresponding to the first pivot portions 13 of the first connecting plate 10. The second pivot portions 21 and the first pivot portions 13 are disposed in an alternate arrangement. A pivot axle 22 passes through the second pivot portion 21, such that the second pivot portion 21 is removably and pivotally combined with the corresponding first pivot portion 13, whereby the second connecting plate 20 and the first connecting plate 10 are able to open and close against each other with the angle included therebetween ranging from 0 to 180 degrees. During the assembling process, the second pivot portions 21 and the first pivot portions 13 are alternately arranged with the pivot axle 22 passing downward through the corresponding first pivot portions 13, the first connecting plate 10 and the second connecting plate 20 are pivotally combined easily. Also, the second connecting plate 20 is provided with a through hole 25 corresponding to the screw hole 15.

When the second connecting plate 20 and the first connecting plate 10 open to 180 degrees, the second connecting plate 20 and the first connecting plate 10 are in a linear arrangement. When the second connecting plate 20 and the first connecting plate 10 close to 0 degrees, the second connecting plate 20 overlap the first connecting plate 10.

Furthermore, in an embodiment of the present invention, two second pivot portions 21 and two first pivot portions 13 are included. Also, each second pivot portion 21 is provided with a flank portion 211, so as to be fastened on a lateral side of the second connecting plate 20 through a screw member 23. Notably, the surface of the first connecting plate 10 and the second connecting plate 20 are provided with recess structures 24, such that when each flank portion 131, 211 is fastened on the corresponding connecting plate, the flank portions 131, 211 are flush with the surface of the connecting plates and prevented from affecting the closing process of the first connecting plate 10 and second connecting plate 20.

The fastening structure 30 is disposed between the first connecting plate 10 and the second connecting plate 20, so as to fasten and fix the first connecting plate 10 and the second connecting plate 20 when the first connecting plate 10 and the second connecting plate 20 are arranged in a close status. The fastening structure 30 includes a protrusion 31 disposed at the second edge 12 of the first connecting plate 10, an engage member 32, a latch handle 33, a fixed seat 34, and a fixed plate 35.

The fixed plate 35 is formed in an L shape. The fixed plate 35 is fastened on a lateral side of the second connecting plate 20 in a manner similar to the way the flanks 131, 211 are fastened on the corresponding connecting plates. Also, the fixed plate 35 is fastened at an end of the second connecting plate 20 which is opposite to the end of the second connecting plate 20 which is pivotally combined with the first connecting plate 10. The fixed seat 34 is fixed with the fixed plate 35, and the latch handle 33 is pivotally combined with the fixed seat 34. The engage member 32 has one end thereof provided with a buckle hole 321 for buckling the protrusion 31, with the other end of the engage member 32 pivotally combined with the latch handle 33 through a pivot pillar 36. By operating and pivoting the latch handle 33, when the first connecting plate 10 and the second connecting plate 20 are close, the engage member 32 buckles the protrusion 31 to maintain the closing stratus of the first connecting plate 10 and the second connecting plate 20, whereby the extension structure 2 is installed on the workbench 1, meeting the demand of different processing operations.

Figure 1:
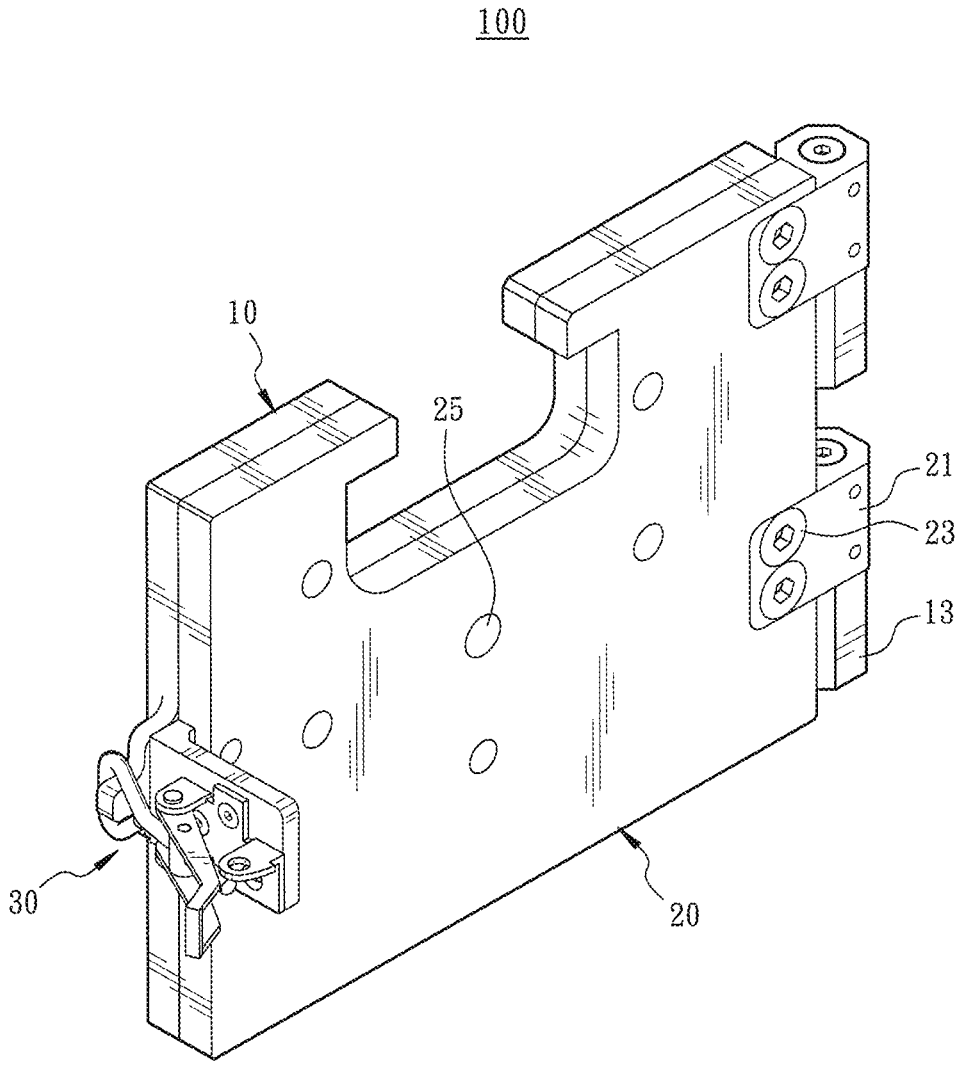
FIG. 1 is a perspective view of the connecting assembly arranged in a close status in accordance with an embodiment of the present invention.
Figure 2:
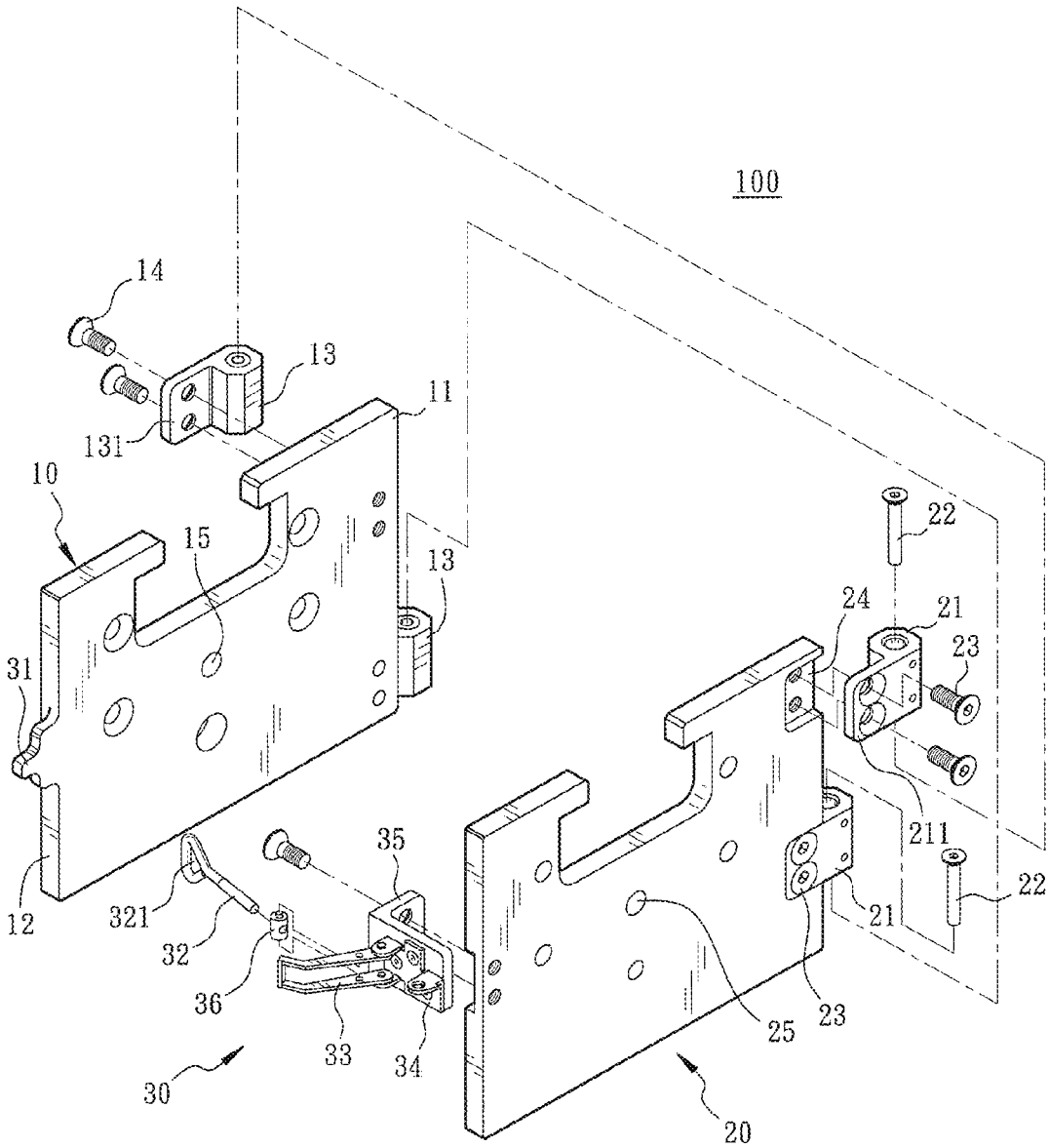
FIG. 2 is an exploded view of the connecting assembly.

Referring to FIG. 1 and FIG. 3, the easily assembled and disassembled connecting assembly 100 further comprises a fixing member 40 which is formed in an elongate hollow shape. When the first connecting plate 10 and the second connecting plate 20 open to 180 degrees, the fixing member 40 is placed across the top of the first connecting plate 10 and the second connecting plate 20, so as to fixing the arrangement and preventing the first connecting plate 10 and the second connecting plate 20 from swaying against each other. With such configuration, when the extension structure 2 is not in operation, the extension structure 2 is able to be pivotally sway to a lateral side of the workbench 1 for not affecting other processing operations.

Referring to FIG. 1 and FIG. 4, the easily assembled and disassembled connecting assembly 100 further comprises a position limiting member 50. The position limiting member 50 is provided with a thread portion 51 for passing through the through hole 25 of the second connecting plate 20 and being screwed into the screw hole 15 of the first connecting plate 10. When the first connecting plate 10 and the second connecting plate 20 are close, the position limiting member 50 passes through the first connecting plate 10 and the second connecting plate 20 for achieving a fixing function, such that the first connecting plate 10 and the second connecting plate 20 are maintained in a closing status.

Figure 6:
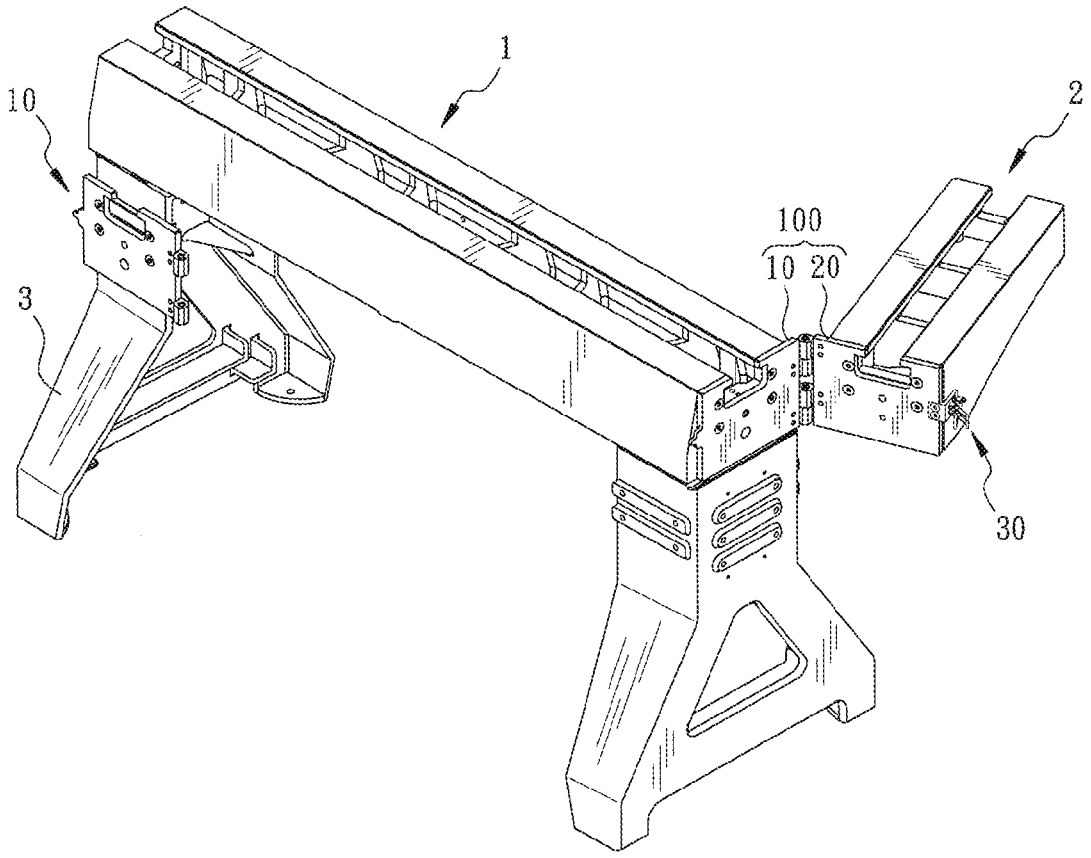
FIG. 6 is a schematic view illustrating the extension structure swaying against the workbench.

Referring to FIG. 5 and FIG. 6, the connecting assembly 100 is applied for installing the extension structure 2 on the workbench 1; also, when the processing operation is finished, the extension structure 2 is able to pivotally sway to a lateral side of the workbench 1 to decrease the overall length for not affecting other processing operations.

Figure 7:
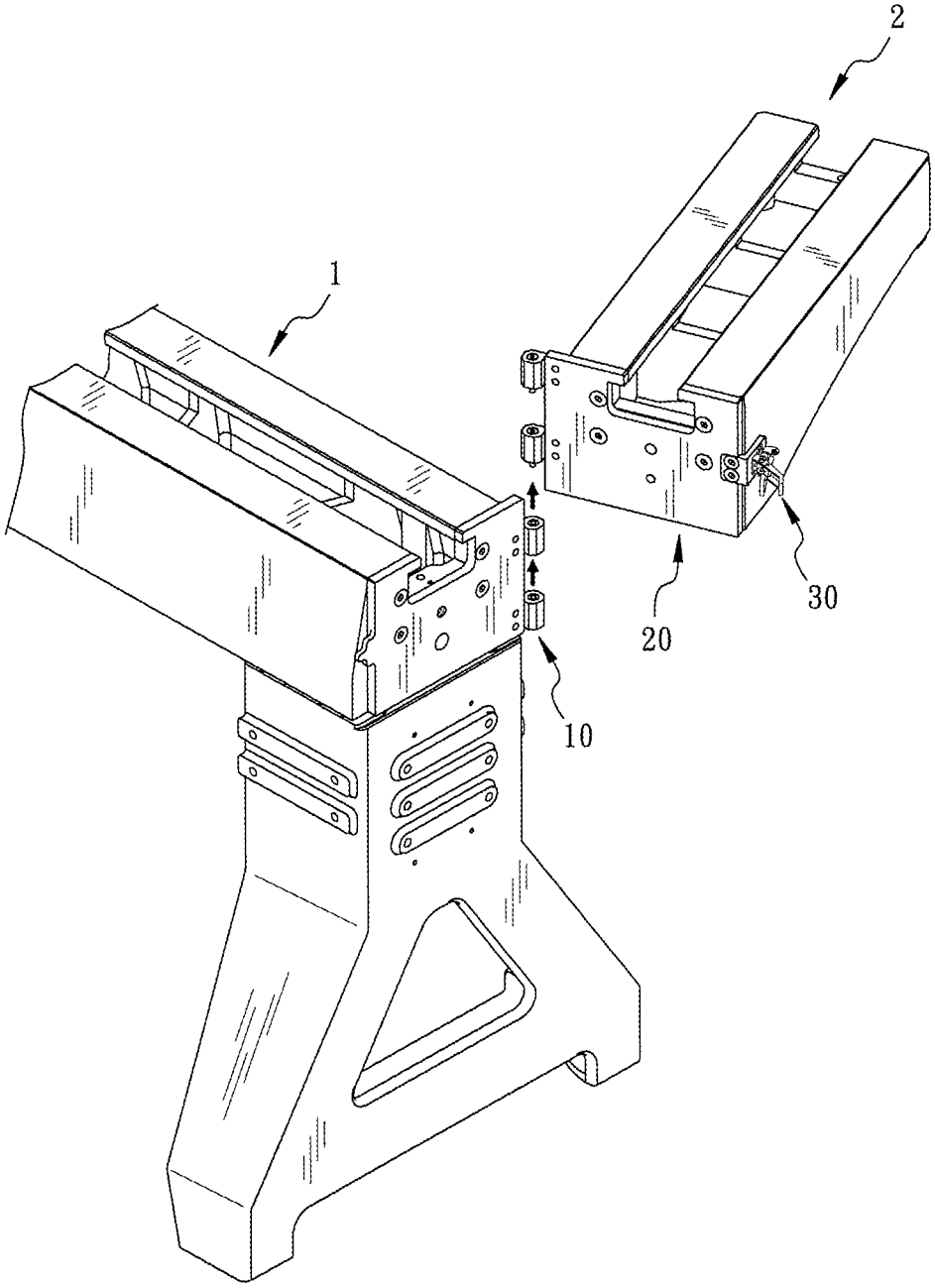
FIG. 7 is a schematic view illustrating the extension structure removed from the workbench.
Figure 8:
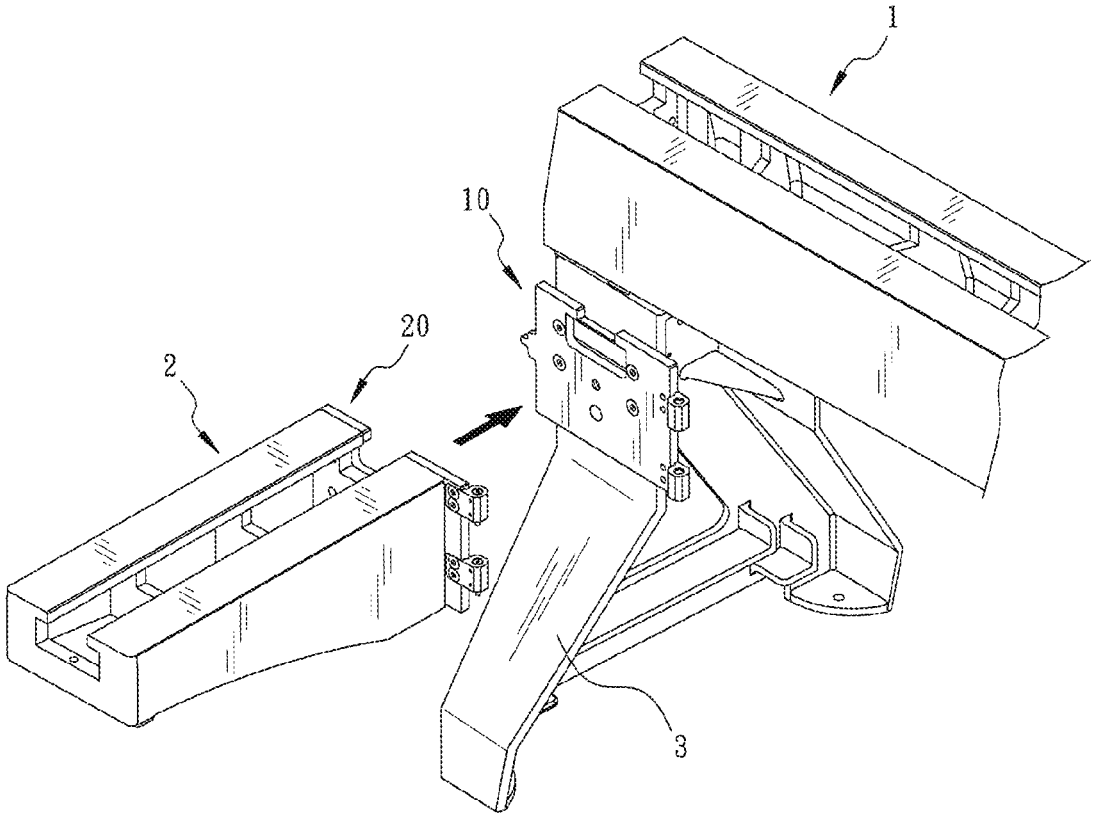
FIG. 8 is a schematic view illustrating the extension structure being installed at a transverse position of the workbench.

Referring to FIG. 7, by use of the connecting assembly 100, the second connecting plate 20 is easily disassembled from the first connecting plate 10, such that the extension structure 2 is uninstalled from a longitudinal position of the workbench 1 and alternatively installed on a transverse position of the workbench 1 for meeting different user demand. Therefore, a processing operation on the transverse position is achieved, as shown by FIG. 8. When the extension structure 2 is installed on a transverse position on a lateral side of a foot 3 of the workbench 1, after the processing operation is finished, the extension structure 2 is able to pivotally sway to an inner lateral side between the workbench 1 and the foot 3, such that the extension structure 2 is not exposed around the workbench 1 and prevented from affecting other processing operation or the operator.

Although particular embodiments of the invention have been described in detail for purposes of illustration, various modifications and enhancements may be made without departing from the spirit and scope of the invention. Accordingly, the invention is not to be limited except as by the appended claims.

What is claimed is:

1. An easily assembled and disassembled connecting assembly, comprising:

a first connecting plate provided with a first edge and a second edge in opposite to the first edge, and the first connecting plate being fastened on a workbench;

a second connecting plate removable and pivotally combined with the first edge of the first connecting plate, such that the second connecting plate and the first connecting plate pivotally move to open and close against each other, and the second connecting plate being fastened on an extension structure of the workbench; and a fastening structure disposed between the first connecting plate and the second connecting plate, the fastening structure fastening and fixing the first connecting plate and the second connecting plate when the two connecting plates are arranged in a close status.

2. The connecting assembly of claim 1, wherein the first connecting plate is fastened at a longitudinal position of the workbench.

3. The connecting assembly of claim 1, wherein the first connecting plate is fastened at a transverse position of the workbench.

4. The connecting assembly of claim 1, wherein the first connecting plate and the second connecting plate open and close with an angle included between the first connecting plate and the second connecting plate ranging from 0 to 180 degrees.

5. The connecting assembly of claim 4, further comprising a fixing member for fixing the first connecting plate and the second connecting plate when the first connecting plate and the second connecting plate open to 180 degrees.

6. The connecting assembly of claim 5, further comprising a position limiting member for passing through and fixing the first connecting plate and the second connecting plate when the first connecting plate and the second connecting plate close to 0 degrees.

7. The connecting assembly of claim 6, wherein the position limiting member is provided with a thread portion, and the first connecting plate is provided with a screw hole corresponding to the thread portion.

8. The connecting assembly of claim 1, wherein the first edge of the first connecting plate is provided with plural first pivot portions; the second connecting plate is provided with plural second pivot portions disposed in an alternate arrangement with the first pivot portions; each second pivot portion is provided with a pivot axle passing through the second pivot portion and the corresponding first pivot portion, such that the second pivot portion is removably and pivotally combined with the corresponding first pivot portion.

9. The connecting assembly of claim 8, wherein the first pivot portions are fastened on the first connecting plate, and the second pivot portions are fastened on the second connecting plate.

10. The connecting assembly of claim 1, wherein the fastening structure comprises a protrusion disposed on the second edge of the first connecting plate and an engage member disposed on the second connecting plate, the engage member buckling the protrusion.

11. The connecting assembly of claim 10, further comprising a fixed seat disposed on the second connecting plate and a latch handle pivotally combined with the fixed seat, the engage member having one end thereof provided with a buckle hole for buckling the protrusion, with the other end of the engage member pivotally combined with the latch handle.

12. The connecting assembly of claim 11, further comprising a fixed plate fastened on the second connecting plate, the fixed plate combined with the fixed seat.

13. The connecting assembly of claim 11, wherein the engage member pivotally combined with the latch handle through a pivot pillar.

* * * * *